US005089089A

United States Patent [19]

Beaulieu

[11] Patent Number: 5,089,089

[45] Date of Patent: Feb. 18, 1992

[54] SYSTEM FOR SULFONATING MECHANICAL PULP FIBERS

[75] Inventor: Serge B. Beaulieu, Mechanicsville, Va.

[73] Assignee: Bear Island Paper Company, Ashland, Va.

[21] Appl. No.: 431,650

[22] Filed: Nov. 3, 1989

Related U.S. Application Data

[60] Continuation of Ser. No. 105,651, Oct. 5, 1987, abandoned, which is a division of Ser. No. 687,877, Dec. 31, 1984, Pat. No. 4,708,771.

[51] Int. Cl.[5] ..... D21C 3/04

[52] U.S. Cl. ..... 162/234; 162/241; 162/242; 162/250

[58] Field of Search ..... 162/234, 241, 242, 243, 162/250, 24, 28, 71

[56] References Cited

U.S. PATENT DOCUMENTS

| | | | |
|---|---|---|---|
| 3,016,324 | 1/1962 | Textor | 162/24 |
| 3,186,899 | 6/1965 | Madison et al. | 162/24 |
| 3,989,588 | 11/1976 | Charters et al. | 162/234 |
| 4,152,197 | 1/1979 | Lindahl et al. | 162/241 |
| 4,259,148 | 3/1981 | Beath et al. | 162/24 |
| 4,502,918 | 3/1985 | Mackie et al. | 162/24 |

*Primary Examiner*—Karen M. Hastings
*Attorney, Agent, or Firm*—R. W. Graham; H. Stanley Muir

[57] ABSTRACT

A two stage sulfonation system includes a mixing tank, a retention tank, a thickening press, a pressurized vessel, and a liquor recovery press in series relation. A sodium sulfite generation unit is connected to maintain a supply of sodium sulfite solution in a holding tank from which a controlled quantity of said solution is metered and injected in the mixing tank. Liquor extracted in the thickening press is cycled back to the mixing tank. Liquor extracted in the recovery press is moved to an intermediate tank and then transferred to the sodium sulfite generation unit, there fortified with fresh sodium sulfite and forwarded to the holding tank to maintain therein an appropriate supply to service the system. The system is designed to receive mechanical pulp, in a slurry form, first introduced into the mixing tank simultaneously with a metered charge of sodium sulfite solution from the holding tank, the sodium sulfite content of which is at a level from about 40 to about 200 g/l. The solution is mixed into the slurry to provide a relatively uniform and intimate contact thereof with its fiber content. This slurry is transferred to the retention tank and there held subject to a sub-boiling temperature between 140 to 210 degrees F., producing a first stage sulfonation of the fiber content. The slurry is then passed to the pressurized vessel, in the course of which it is subjected to a pressing action, extracting liquor which inherently contains a majority of the original sodium sulfite charge directed to the mixing tank. A second stage sulfonation occurs in the pressurized vessel, producing a fiber which after refining is suited for use as reinforcing pulp in newsprint or specialty grade paper, without need for addition of conventional chemical pulp.

6 Claims, 3 Drawing Sheets

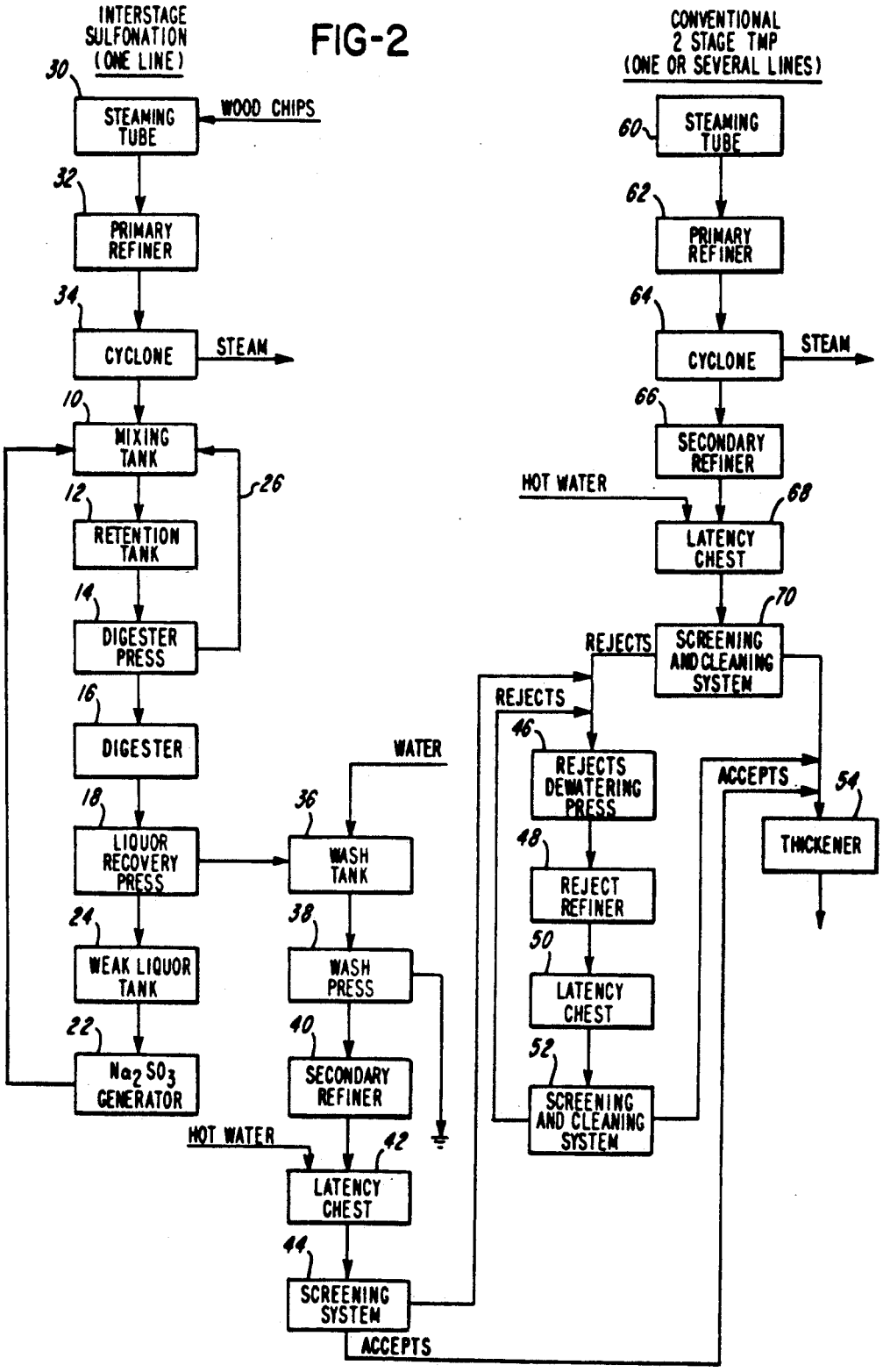
FIG-2
INTERSTAGE SULFONATION (ONE LINE)
30
STEAMING TUBE
WOOD CHIPS
32
PRIMARY REFINER
34
CYCLONE
STEAM
10
MIXING TANK
26
12
RETENTION TANK
14
DIGESTER PRESS
16
DIGESTER
18
LIQUOR RECOVERY PRESS
24
WEAK LIQUOR TANK
22
$Na_2SO_3$ GENERATOR
WATER
36
WASH TANK
38
WASH PRESS
40
SECONDARY REFINER
HOT WATER
42
LATENCY CHEST
44
SCREENING SYSTEM
ACCEPTS
REJECTS
REJECTS
46
REJECTS DEWATERING PRESS
48
REJECT REFINER
50
LATENCY CHEST
52
SCREENING AND CLEANING SYSTEM
CONVENTIONAL 2 STAGE TMP (ONE OR SEVERAL LINES)
60
STEAMING TUBE
62
PRIMARY REFINER
64
CYCLONE
STEAM
66
SECONDARY REFINER
HOT WATER
68
LATENCY CHEST
70
SCREENING AND CLEANING SYSTEM
REJECTS
ACCEPTS
54
THICKENER

SYSTEM FOR SULFONATING MECHANICAL PULP FIBERS

This application is a continuation of pending prior application Ser. No. 07/105,651 filed under 37 CFR 1.60 on Oct. 5, 1987, now abandoned, by Serge B. Beaulieu for "SYSTEM AND APPARATUS FOR SULFONATING MECHANICAL PULP FIBERS" as a divison of the then pending prior parent application Ser. No. 06/687,877 filed on Dec. 31, 1984 by Serge B. Beaulieu for "SYSTEM AND PROCESS FOR SULFONATING MECHANICAL PULP FIBERS", the latter of which issued as U.S. Pat. No. 4,708,771 on Nov. 24, 1987.

BACKGROUND OF THE INVENTION

This invention relates to a new and improved system and process for the enhancement of mechanical pulp wood fibers having application to the production, processing and adaptation of mechanical pulp to a form providing a product eminently suited to the making of quality newsprint and groundwood specialties. It provides an answer to a number of problems which have existed for a considerable number of years. These problems derive from the fact that pursuant to the existing prior art it is deemed essential to add a substantial quantity of expensive chemical pulp to a given amount of mechanical pulp in order to achieve a resultant pulp which is satisfactory for the production of newsprint or groundwood specialties such as supercalendered or light weight coated paper. Not only is the chemical pulp expensive and increasing in cost but the very nature of it is such that the chemicals thereof tend to adversely affect desirable properties of the mechanical pulp with which it must be combined. Furthermore the addition of chemical pulp has been found to inherently limit the optical and printing properties of those paper products to which the combined pulp is applied. Another important adverse factor is that the chemical pulp is a low yield pulp. This last evidences both a resource and an environmental problem since our supply of trees and has become seriously depleted.

The most pertinent of the previous efforts to solve the noted problems produced a suggestion that they may be alleviated by a single stage sulfonation of mechanical pulp, namely by spraying it with a suitable chemical in the course of its conventional processing. However the cost of the chemicals for such purpose has proven to be very high and the results thereof unsatisfactory.

As will be seen from the following disclosure, the present invention deals with and affords a highly satisfactory solution to the foregoing problems and at the same time makes a significant contribution to the art in several respects.

A basic feature of the embodiments and practice of this invention is a two stage sulfonation system and process which can be applied to the enhancement of mechanical pulp in a number of ways and in reference to a number of different types of such pulp, in the process of which to save a significant amount of chemical and its cost, to reduce energy requirements in the application of the resultant pulp to the production of newsprint, groundwood specialty papers and the like and to provide a quality of the mechanical pulp obviating need for addition thereto of chemical pulp as practiced in the prior art.

The foregoing references to the prior art exhibit the extent of background knowledge of which those substantively involved in the preparation of this disclosure are aware. They know of no prior art specifically pertinent to the points of novelty herein set forth as forming part of the present invention.

SUMMARY OF THE INVENTION

The system and process of the invention is characterized by applying a solution of sodium sulfite to a slurry of mechanical pulp to establish a low consistency thereof, placing the solution in uniform and intimate contact with wood fibers forming solids content of the slurry, maintaining said contact for a period of time sufficient to initiate an interaction between sodium sulfite in solution and the surfaces of said fibers, producing thereby a first stage sulfonation of said fibers, and subsequently increasing the consistency of said slurry and subjecting the fibers therein, the sulfonation of which has been commenced, to an elevated temperature and pressure the levels of which are controlled to drive the sulfonate content of said fibers to a much higher level using a minimal sodium sulfite charge.

In the preferred form of practice of the present invention the application of sodium sulfite is quite limited. Furthermore, the arrangement for its application in solution is such that any unit operation which employs the same is distinguished by a low net consumption of sodium sulfite. At the same time, the net result is a significant improvement of most of the physical properties of the fibers conditioned thereby, rendering them most suitable for use in producing newsprint and a variety of groundwood specialty papers. All this is achieved without need for the usual addition of a considerable amount of chemical pulp such as heretofore dictated by prior art practice.

A significant feature of the invention is that only a minor fraction of a mechanical or thermo-mechanical pulp furnish for newsprint or groundwood specialty paper needs to be sulfonated to provide the important benefits of this sulfonation to the whole. It has been found and established in tests that upon an introduction of this minor fraction to the remainder of the furnish, the total furnish is then endowed with beneficial properties to a level sufficient to produce a product the quality of which is highly competitive with that produced in accordance with the prior art teachings and at a lower cost.

Wood fibers derived from any one of the different species of trees suitable for pulping, such as Southern Pine, Balsam Fir and Black Spruce, are all dramatically improved as to their properties when subjected to the two stage sulfonation process of the present invention. They then show superior wet and dry handsheet characteristics, evidenced for example by the increase in their breaking length and their decrease in specific volume for a given refining energy level being plotted against chemical charge. The two stage system and process of the invention has been clearly found to have an zbility to achieve substantial improvement of the physical properties of the wood fiber with a low chemical charge because of its particular ability to quickly endow the fibers with a relatively high sulfonate content using a low chemical charge. The invention additionally provides a system and process by means of which one can produce an improved mechanical or thermo-mechanical pulp at a specific energy level which is lower than that experienced in using the procedures of the prior art.

A basic system for use in practicing the invention process is characterized by a mixing tank, a holding or retention tank, a dewatering press, a pressurized vessel and a recovery press in series relation. The mixing tank is designed to simultaneously receive a mechanical pulp in a slurry form and a sodium sulfite solution and to provide means to induce a uniform mixing of the sodium sulfite solution with the surfaces of the mechanical pulp fibers. Means are provided to direct this mixture to the holding tank which is constructed and arranged to hold the contents of the slurry which it receives at a sub boiling temperature, for a limited period of time. The holding tank provides a first stage sulfonation station having in connection therewith means for forwarding the slurry to the dewatering press. The latter is constructed and arranged to extract a substantial portion of the slurry liquor, including sodium sulfite solution which embodies a major portion of the sodium sulfite furnished in the first instance to the mixing tank. This extracted liquor is directed back to the mixing tank by means of an interconnecting transfer line. A further transfer line directs the remaining slurry, which now has a high consistency form, to the pressurized vessel. The pressurized vessel provides means for holding its contents under pressure and establishing a temperature and pressure therein to enforce a second stage relatively high level sulfonation of its wood fiber content.

The product resulting in the pressurized vessel is then further dewatered in a recovery press to extract attendant liquid having therein a residual portion of the charge of sodium sulfite which was first introduced to the now sulfonated pulp fibers in the mixing tank.

A preferred embodiment of the above described system has a sodium sulfite generating unit in connection therewith arranged to receive the weak liquor which is extracted from the pulp in the recovery press. This liquor contains a measure of sodium sulfite which is fortified by a small amount of sodium sulfite in the generating unit. The generating unit in turn is arranged to maintain a required sodium sulfite solution in a holding tank from which it is automatically metered, by set controls, to the mixing tank. The manner in which the originally applied sodium sulfite charge is utilized to its fullest in maintaining a required level thereof in the mixer enables an optimally functioning sulfonation system wherein the demand for fresh chemical is small.

There is substantial flexibility in the means and manner in which the invention system and process may be employed. It is suited for various arrangements of interstage sulfonation and may be applied intermediately to sulfonate rejects as well as used separately in one or more lines of an installation. In either case it provides unexpectedly efficient means and mode of enhancing a basically mechanical pulp.

Most importantly, the invention in all or any of its aspects of application provides a process which is simple and can be retrofitted to any existing mechanical pulping installation.

It is therefore a primary object of the invention to provide a new and improved system and process for achieving the enhancement of mechanical pulp wood fibers which is economical to install and execute, most efficient and satisfactory in use, adaptable to a wide variety of application and gives assured results in use thereof.

Another object is to provide a new and improved means of and method for enhancing any one of a variety of mechanical pulps or combination thereof in a manner to produce a pulp product eminently suited for use as newsprint or one similarly suited for use in production of one of a variety of groundwood specialty papers without need for addition thereto of chemical pulp of the nature and as prescribed by the prior art.

A further object is to provide a new and improved two stage system and process for sulfonating the wood fibers of mechanical pulp.

Another object is to provide a new and improved mechanical pulp fiber enhancement system and process providing, in series relation, a low and high consistency sulfonation thereof the level of which improves almost all the properties of the wood fibers without material adverse effect on the remaining properties.

A further object is to provide a simple multi-stage system and process for sulfonating the wood fibers of mechanical pulp which enables their production at lower specific energy levels.

An additional object is to substantially decrease the sodium sulfite charge heretofore required in application to mechanical pulp fibers to produce therein the bound sulfur levels required for the enhancement thereof prior to and during a refining operation.

Another object is to provide a new and improved system and process for effecting a multi-stage sulfonation of mechanical pulp processing the advantageous features, the inherent meritorious characteristics and the means and mode of application and use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings which show some but not necessarily the only forms of embodiment and practice of the invention.

FIG. 2 illustrates the system and process of FIG. 1 applied to interstage sulfonation.

Like parts are indicated by similar characters of reference throughout the several views.

Figure 1:
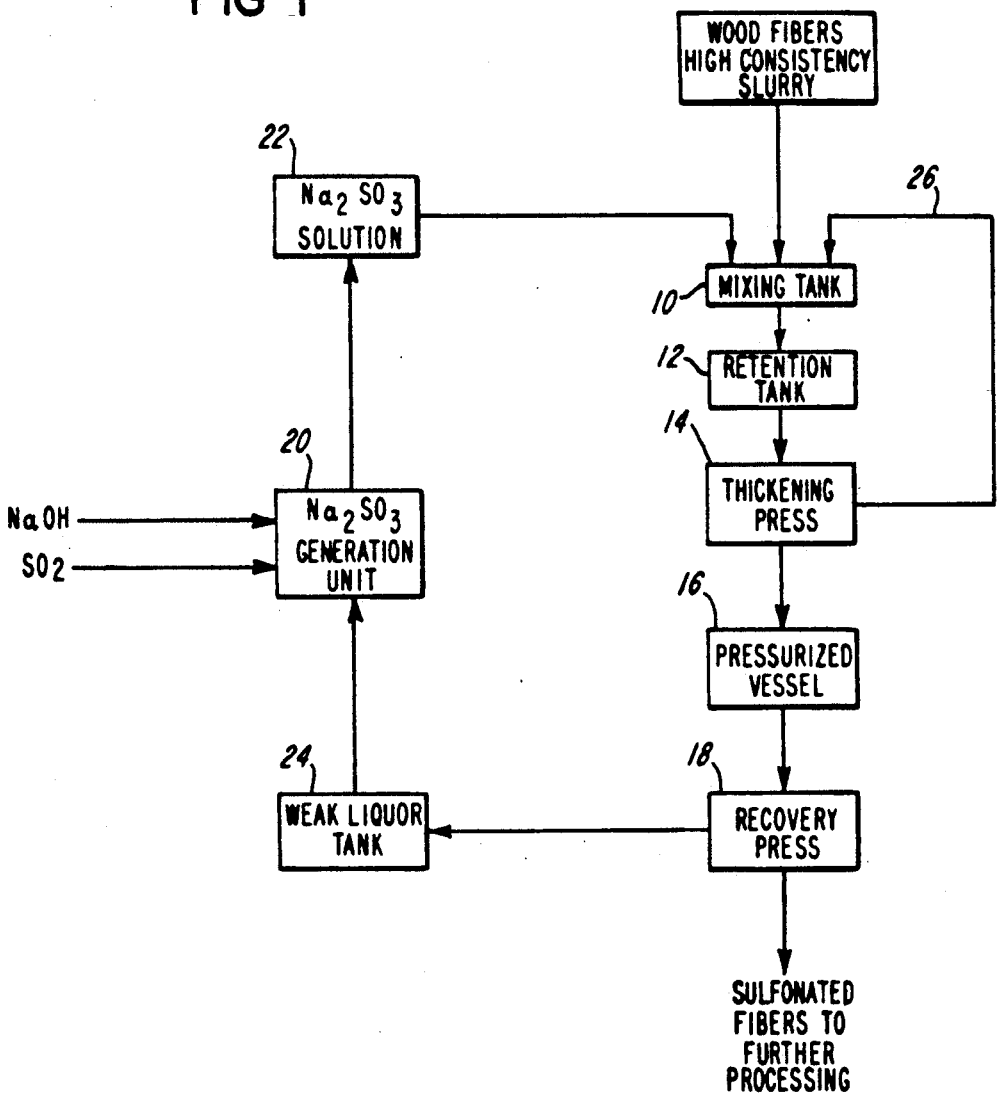
FIG. 1 illustrates a system and process for the sulfonation of mechanical pulp fibers per the present invention.

The flow sheet of FIG. 1 illustrates a two stage sulfonation system per the invention comprising a mixing tank 10, a holding or retention tank 12, a thickening press 14, a pressurized vessel 16, preferably a digester, and a recovery or dewatering press 18, in successively disposed series relation. This system further includes a sodium sulfite generation unit 20, itself connected to deliver and maintain a supply of a sodium sulfite solution in a tank 22 from which a controlled quantity of the solution can be metered, in accordance with the level of the requirements therefor, to the mixing tank 10. At the same time an intermediate tank 24 is connected to receive liquor extracted from the pulp being processed in the illustrated sulfonation system as it passes through and from the press 18. The tank 24 is suitably connected to subsequently deliver its liquor content to the sodium sulfite generation unit 20.

A further recirculation of extracted liquor occurs in the use of the described system, by way of a return line 26 which extends from the press 14 to the mixing tank 10.

As thus comprised, FIG. 1 demonstrates multi-stage sulfonation, specifically a two stage sulfonation system which as compared to the prior art has proven to be significantly effective and to have unexpectedly beneficial results. This system is characterized by a simplistic execution and economy in use.

Basically, as illustrated, in the practice of the process of the invention, there is delivered to the mixing tank 10 a furnish of mechanical pulp, in this instance in a high consistency (20% to 50%) slurry form, the wood fiber content of which may have been derived from the reduction of any one or combination of the many species of trees suitable for mechanical pulp, utilizing any of the numerous procedures conventionally practiced in this respect.

At the same time as this high consistency slurry is introduced to the tank 10 there is delivered thereto from the tank 22, in a metered fashion, a sodium sulfite solution the sodium sulfite content of which is in a proportion of about 40 to 200 grams per liter, the particular proportion in this range being dependent on the trees from which the fibers have been derived. The amount of the solution will be such that the high consistency (20% to 50%) of the delivered mechanical pulp is reduced to a consistency level in the range of about 1% to 7%, the consistency within the range depending on the nature of the fibers and the end product desired.

Note should be taken of the fact that the fibers being sulfonated in this system may originate from different sources such as, for example, RMP, TMP or Stone Groundwood.

In any case, within the tank 10 the incoming slurry and the sodium sulfite solution are thoroughly intermixed to bring the wood fiber content into individual intimate contact with the sodium sulfite solution. The form and nature of the mixing equipment employed is not detailed since such details do not per se exhibit the novelty of the present invention and are well understood as within the skill of one versed in the mixing art.

Immediately following the mixing procedure in the tank 10, the duration of which is relatively brief, the slurry which now has a 1 to 7% consistency is passed to the retention tank 12 and the fiber content thereof is there held in suspension, in intimate contact with the individual fibers, at a temperature the degree of which is in a range from about 140° to 210° F. for a period from 10 to 150 minutes. The dwell time is dependent on the variety of the fiber and the nature of the desired end product.

The conditions under which the fibers are thus treated in the mixing tank 10 and the retention tank 12 provide first a uniform mixing of the sodium sulfite solution with the surfaces of the mechanical pulp fibers in an efficient way effective to start a sulfonation reaction impressed and propogated during the suspension and dwell of the fibers in continuing intimate contact with the sodium sulfite solution in the tank 12. This is a first stage sulfonation procedure during which, as has been determined and established in test, the wood fibers in the slurry can be readily endowed with sulfonate levels between 0.5 and 0.9%.

Following their retention in the tank 12 the slurry contents resulting are directed to the thickening press 14 wherein they are dewatered and there is thus extracted therefrom a strong liquor the sodium sulfite level of which is such that it contains most of the original chemical charge thereof delivered to the tank 10. This extracted liquor is returned to the tank 10 for reuse with and on the contents of the following mechanical pulp then entering the sulfonation system at the tank 10. As will be readily obvious, this minimizes the amount of make up sodium sulfite solution which must be metered from the holding tank 22 to the mixing tank. By means of the dewatering procedure effected therein the slurry originally received in the press 14 is thickened to the level of a 12% to 40% solids consistency. This high consistency slurry is then delivered to the pressurized vessel 16, which is preferably a vapor phase digester, in which it remains for a period of 10 to 60 minutes under a pressure level of 40 to 90 psig and under the influence of a temperature the degree of which is in the range of 280° to 360° F. The reaction that occurs during this dwell interval provides a second stage sulfonation treatment in the course of which the sodium sulfite surrounding and attaching to the wood fibers further react on and drive the coating of the fibers to a high sulfonate level. There can be a measure of residual sulfonation as the slurry issuing from the digester 14 is "dewatered" in the recovery press 18.

The whole sulfonation procedure is achieved by means of this simple two stage treatment which requires the use of only a small amount of fresh sodium sulfite.

As will be readily seen from the foregoing, most of the sodium sulfite originally introduced to a given charge of slurry delivered to the mixer 10 is returned back to the mixer for reuse in commencing sulfonation of a further charge of the delivered slurry embodying mechanical pulp. Furthermore, the liquor extracted in the press 18 which contains a residual amount of sodium sulfite is also recycled, by way of the tank 24, to the sodium sulfite generating unit 22 to there be refortified from its sodium sulfite content and minimize, in this way also, the need for introduction in the system of fresh chemicals to provide the sodium sulfite solution required to maintain the strength of that which is delivered to and held in the tank 22.

The foregoing is a basic disclosure of the two stage sulfonating system of the invention which is applicable to mechanical pulp and in use thereof very quickly and easily produces essentially the equivalent of an addition to such mechanical pulp of a much more expensive chemical pulp. The significance of what is produced in the two stage sulfonation of wood fibers as here described is that the results are such that in any given production of newsprint, only a small portion of the mechanical pulp supplied for the newsprint is required to be sulfonated in this manner. The same applies to the furnish for the production of specialty grade papers.

For example, but not by way of limitation, with a 100% mechanical pulp furnish for newsprint, only 25% need be sulfonated. On its combination with the other 75% of the furnish the resultant pulp is found admirably suited for newsprint and to have a quality which is highly competitive with prior art pulp furnish for newsprint which embodies therein conventionally contrived highly expensive chemical pulps such as dictated by the procedures and systems for producing newsprint in accordance with the prior art.

Tests have shown that, as compared to prior practice in achieving a pulp furnish appropriate for production of newsprint and groundwood specialty papers, the use of the multi-stage and interstage sulfonation systems of the present invention have evidenced the following benefits and improvements in the art:

(a) a substantial decrease in the chemical charge required to reach the bound sulfur levels for the necessary enhancement of mechanical and thermo-mechanical pulp fibers;

(b) a production of quality mechanical pulp that can be achieved at lower specific energy levels;

(c) a substantial savings in the cost of applied chemical with an achievement of equal and better results than heretofore;

(d) a substantial improvement in the wet and dry properties of mechanical and thermo-mechanical wood pulps enabling quality newsprint and groundwood specialty papers to be made at higher operating speeds;

(e) the introduction of a most simplisitic, economical and beneficial system and process which is completely flexible as to its application and can be retrofitted to any existing type of mechanical pulping operation with beneficial results, even where the wood fibers being processed are derived from different trees among those suitable for mechanical pulp.

Figure 3:
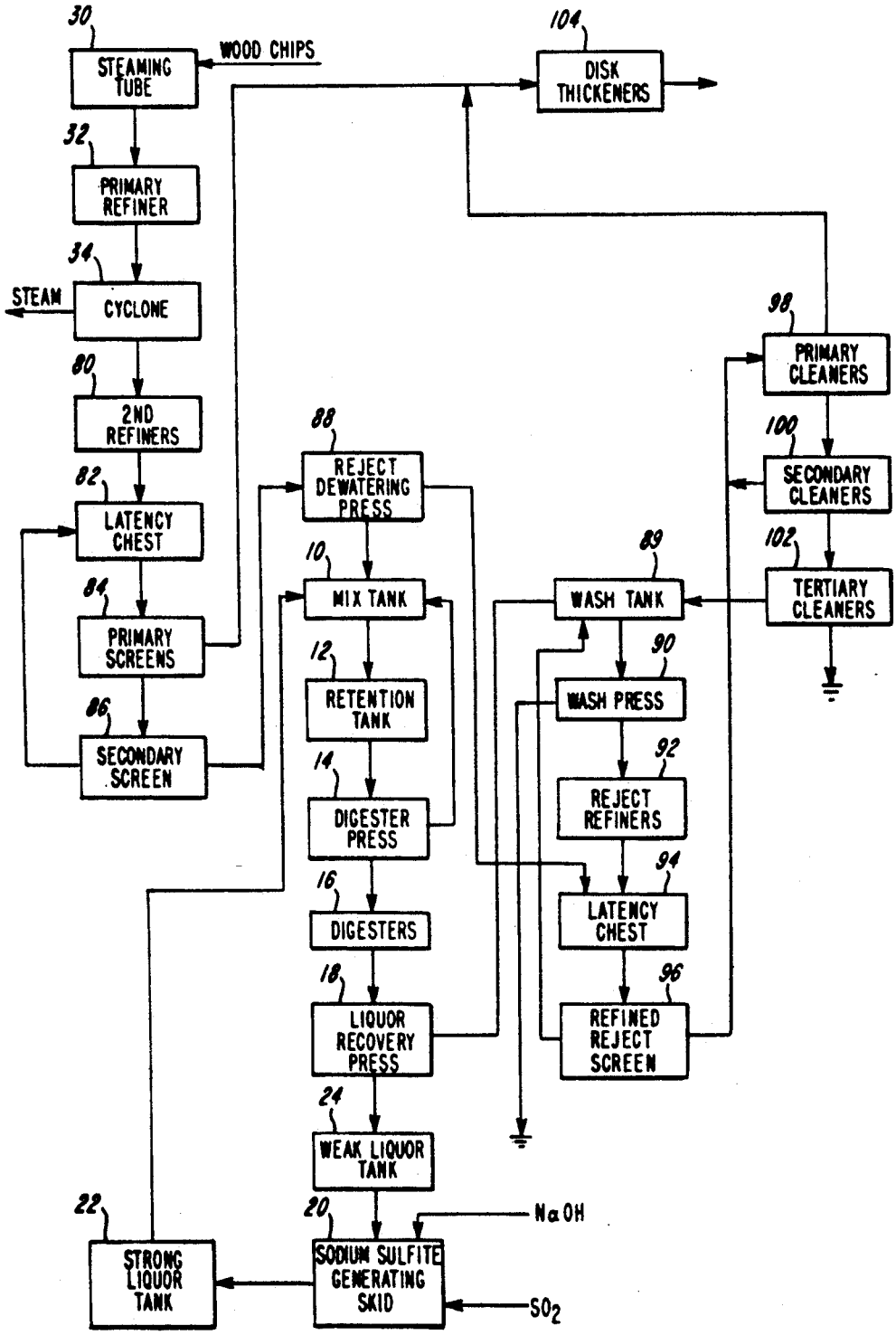
FIG. 3 illustrates a TMP and long fiber sulfonation system utilizing interstage sulfonation as applied to the reject fraction of a mechanical pulp furnish in the course of production of newsprint.

The versatility of application of the invention system and process is illustrated in FIGS. 2 and 3 of the drawings, by way of example and not by way of limitation.

FIG. 2 shows the basic essentials of the application of the invention system of FIG. 1 to a system for the processing of TMP (thermo-mechanical pulp) for the production of newsprint.

As illustrated the system of FIG. 2 utilizes a plurality of production lines and provides that the total wood chip furnish be divided into parts with the majority thereof being directed into one or more lines wherein they experience a conventional two stage TMP (thermo-mechanical pulp) processing. The remaining part, from 15 to 40 percent of the whole furnish, is directed to and through a separate line wherein, in addition to TMP (thermo-mechanical pulp) refining, the wood fiber content thereof is subjected to interstage sulfonation in a manner such as described with reference to the showing in FIG. 1 of the drawings. For convenience of disclosure, the said one or more lines wherein conventional TMP (thermo-mechanical pulp) processing takes place is illustrated as a single line.

As schematically shown, within the line wherein there is interstage sulfonation the chips are first conditioned by steam in a tube 30, from which they are passed to a refiner 32, preferably a disc refiner, for their reduction. In the normal course of this steaming and refining procedure, the chips in their resultant defibered forms, comprised of fibers and fiber bundles, conventionally experience the addition thereto of water. As a result, the substance which issues from the refiner 32 has a diluted slurry form. This slurry is then passed to and through a cylcone type separator 34 the function of which is to separate and direct therefrom attendant steam. The separated steam is recycled or otherwise directed for further use. The slurry which issues from the normal discharge opening of the cyclone 34 is conventionally one which has a high consistency form, the range of which is generally within that of the slurry introduced in the sulfonation system described with reference to FIG. 1.

At this point the fibers of the slurry are subjected to a sulfonation treatment in a process and procedure in accordance with the present invention, such as described with reference to FIG. 1 of the drawings. Accordingly, there is successively provided, in directly following series relation to the cyclone 34, a mixing tank 10, a holding or retention tank 12, a thickening press 14 represented in this instance as a digester press, a pressurized vessel 16 represented in this instance as a digester, and a dewatering press 18 which is labeled "liquid recovery press". Associated with the series of units 10, 12, 14, 16, and 18 is a supply system for directing a sodium sulfite solution into the tank 10, in metered fashion, in concert with the delivery to this tank of the content of the slurry discharged from the cyclone separator 34. The means and method of providing the necessary sodium sulfite in the sulfonation system of FIG. 2 is essentially identical with that described previously, being inclusive of a sodium sulfite generation unit 22 which in this case embodies in connection therewith the equivalent of the holding tank 20 for the sodium sulfite solution which is metered to the mixing tank 10. As in the instance first described, the generation unit 22 is supplemented and supported in its function by the return thereto from the sulfonation system, by way of the tank 24, of that residual sodium sulfite which will exist in the liquor extract achieved in the press 18. At the same time, the liquor extracted in the press 14, which contains a major portion of the sodium sulfite first introduced to the mixing tank 10, is recycled to this tank by way of the delivery line 26, to thereby strengthen and fortify the sodium sulfite solution therein and substantially reduce the demand for introduction of further sodium sulfite solution from the holding tank in connection with the sodium sulfite generating unit 22.

The sulfonation process and the manner in which it is executed in this instance will be the same and conducted utilizing the same parameters as first described. Therefore, the previous description thereof is included at this point, by reference, to avoid being unduly repititious and redundant in this respect. Under such circumstances, it should be clear as to how and to what extent the fibers of the wood content of the slurry delivered from the cyclone 34 are conditioned and enhanced in the system and practice in the process applied in the installation of FIG. 2.

It is noted, however, that the concentration of the sodium sulfite solution which is applied at the mixing tank 10 will, as should be obvious, vary with the wood species delivered to the tank and will depend on the level of enhancement of the fibers that may be desired.

By way of example but not by way of limitation, in the event that the original woodchips are derived from Southern Pines, the sodium sulfite sulfite should preferably have a sodium sulfite content the level of which is in the neighborhood of 70 g/1 and the amount thereof introduced to the tank 10 should preferably be such to provide a resultant slurry the consistency of which is about 4.5 percent. Furthermore, in the retention tank 12 the contents of the slurry delivered thereto at 4.5 consistency should preferably be held for about 20 minutes and subjected therein to a temperature level the degree of which is in the neighborhood of 180° F. Furthermore, the consistency of the slurry passed from the digester press 14 to the pressurized vessel in the form of the digester 16 should preferably have a consistency which is in the neighborhood of 25%. In the following treatment of the fibers in the pressurized vessel 16, the retention time for the slurry and its wood fiber content should preferably be in the range of 20 minutes. This should optimize the sulfonation results.

In any case, the parameters and conditions of the sulfonation of any of the various wood fibers suitable for and subjected to mechanical pulping for use in providing a furnish for the production of newsprint or groundwood specialty papers will all fall generally within the range of those first stated with reference to the description of the system of FIG. 1.

Accordingly, the accepts in the form of the slurry containing sulfonated wood fibers achieved in the press 18 are all delivered to a wash tank 36 wherein excess and undesirable elements are washed from the fibers and then extracted in the following press 38. This last liquor extract will be suitably disposed of. By contrast, the sulfonated fibers, constituting the accepts of the press 38, at this point a high consistency slurry form, are delivered to a secondary refiner 40 wherein they are further refined and subsequently introduced into a latency chest 42 wherein they are treated with hot water to eliminate curl. Subsequently the resultant composition, in a low consistency form, is delivered to and through a screening system 44. The latter may be of any conventional nature such as used in TMP (thermomechanical pulp) systems.

The acceptable long flexible sulfonated fibers which have been achieved in the preceding TMP refining-double stage sulfonation system and confirmed in the screening and cleaning system 44 are then delivered, in a low consistency slurry form, to and through a thickener in the nature of a suitable press 54, whereupon the resultant fibers will be in a condition to serve as furnish for the production, in this case for example, of newsprint.

At the same time, in the installation illustrated, each of the one or more lines in which the majority of the wood chips are being processed in a conventional two stage TMP operation are functioning without the benefits of the interstage sulfonation procedure which is embodied in the line just described. Each of these conventionally operating lines basically comprise, in series relation, a steaming tube 60, a primary refiner 62, a cyclone separator 64, a secondary refiner 66, a latency chest 68 and a screening and cleaning system 70. These units 60 through 70 correspond in structure and function with the units 30, 32, 34, 40, 42 and 44 of the line just described wherein sulfonation additionally occurs. Of course, there can be additional components in the conventional TMP system, as needs require, including but not limited to such as the wash tank 36 and the wash press 38. It is to be understood that the schematics employed to set forth the conventional aspects of the pulp processing system of FIG. 2 are not all inclusive as to the units which may form part thereof since the specifics in this respect will in each case depend on the particular end application which is contemplated for the pulp. At any rate, the acceptable fibers derived in the TMP lines are in the case of each line directed to the thickener 54 simultaneously with the delivery thereto of the accepts from the line in which there has been an interstage sulfonation procedure. The arrangement is such to enforce a blending of the conventional TMP and the sulfonated TMP fibers in a manner which delivers them in combination to and through the thickener 54. In such combination the total of the discharged pulp will be endowed with benefits and improvements created by the blending therein of the sulfonated pulp.

As will be further seen from FIG. 2, the rejects from both the screening system 44 and the screening system 70 are similarly blended, then passed in succession through a rejects dewatering press 46, a reject refiner 48, a latency chest 50 and a screening and cleaning system 52, each of which serves their previously described known functions, well understood in the art. The net result is that the rejects of the conventional TMP processing and from the sulfonated TMP procedures are commonly worked and blended to produce in their processing an accept composition which can also be blended into the blend of the originally accepted fibers passing to the thickener 54 to produce a form of pulp eminently suited for the production of newsprint. Any rejects which are further rejected at the screening and cleaning system 52 will continue to be recycled and at the end of the operation those which are unsatisfactory, a small fraction of the whole, are disposed of.

FIG. 3 exemplifies a system wherein pulp suited for newsprint is produced by applying, only to the rejects of a RMP/TMP operation, a sulfonation system corresponding to that of FIG. 1.

This system comprises a steaming tube 30, or its equivalent, a primary refiner 32, a cyclone separator 34, a secondary refiner 80, a latency chest 82 and primary and secondary screen systems 84, 86, in series relation. These correspond to the units 60, 62, 64, 66, 68 and 70 of the conventional TMP line of FIG. 2 and at the same time correspond to the units 30, 32, 34, 40, 42, 44 of the same FIGURE. The primary refiner 32 of FIG. 3 is preferably a pressurized disc refiner as would be the case in its application to the system of FIG. 2. In the practice of the process of the invention of FIG. 3, the total of the wood chip furnish required is initially introduced to the steaming tube 30 and therein initially conditioned prior to its first refining utilizing any one of several known options available in this respect. Following this conditioning procedure the chips are then subjected to defibering, under pressure, in the primary refiner 32, in the course of which there is some application of water. This procedure is conventional and produces a slurry having a high consistency of wood fibers and fiber bundles. The resultant slurry and its contents are then passed through the cyclone 34 where steam is separated therefrom and appropriately retrieved for further use thereof. The contents of the slurry issuing from the normal discharge opening of the cyclone are then passed to a secondary refiner 80 wherein the aforementioned fibers and fiber bundles are then further conditioned and reduced in a conventional manner to further separate the individual fiber content thereof. Following this the slurry and its contents are moved from the secondary refiner 80 to the latency chest 82 where hot water is added and the fiber content thereof is induced to relax their curl. On discharge from the chest 82 the slurry is moved to a screening and cleaning system 84 which is effective to separate acceptable fiber content thereof, which includes the longer and stronger of the fibers, from the unacceptable portion of its fiber content which at this point are considered to be rejects. The accepts resulting from the primary screening, which are suitable for use for their intended purpose, are directed toward the exit from the system, in the process of which to move to and through thickeners, in the case illustrated disk thickeners 104.

The rejects of the primary screening procedure are subjected to a secondary screen system 86 for their further cleaning and classification by virtue of which those then deemed acceptable for further processing are delivered in slurry form to a reject dewatering press 88. Those rejects deemed unacceptable on the secondary screening thereof are recycled back to the latency chest 82, to join inflow thereto from the secondary refiner, for movement therewith and further conditioning and subsequent grading thereof in subsequent passage through the primary and secondary screening systems 84 and 86.

It is here noted that from 15% to 40% of the wood chip furnish will be directed to the reject dewatering press 88 and from there to and through a sulfonation system such as basically shown and described with reference to the flow sheet of FIG. 1, under similar conditions and controls and within the parameters first set forth, variations again being determined by the nature of the wood fibers and the degree of sulfonation desired, which depends on the end application of the pulp being processed. Again, as stated in the case of the system of FIG. 2, a repetitious discussion of the sulfonation system itself would be redundant and serve no useful purpose, given the previous detailed description thereof. The sulfonation of the rejects in this instance will result in the same accrual of benefits and enhancement of the wood fiber content thereof as previously described. It is noted also that while the majority of the rejects passed to the press 88 from the secondary screen 86 will be subsequently delivered in high consistency form to the mixing tank 10 to commence their sulfonation and enhancement, there will be an acceptable portion remaining which will directly pass to a downstream latency chest 94 for its continued processing.

As shown in FIG. 3, the high consistency slurry directed from the press 88 to and through the mixing tank 10, the retention tank 12, the digest press 14, the pressurized digester(s) 16 and press 18 will be fully treated and the fiber content thereof sulfonated in accordance with the two stage process of the invention.

The sulfonated fibers issuing from the press 18 are directed, in succession, to, through and from a wash tank 89 and a wash press 90 for secondary refining in the reject refiner(s) 92, subsequent to which they are delivered to a latency chest 94 in which they are subjected to a hot water treatment such as previously described and following this to a screening system 96. The accepts resulting in their application to the screening system 96 are routed to and through a primary cleaner 98. The accepts developed in the operation of the cleaner 98 include primarily the longer and stronger flexible fibers thereof which are passed directly to the system discharge line extending from the primary screen system 84 to the disc thickeners 104. On entry to this discharge line, the sulfonated fibers directed thereto are induced to intermix and blend with the conventionally processed fibers acceptable to endow the whole with conspicuous benefits having their source in the original sulfonated portion of the fibers. Just why and how these benefits and the conspicuously improved properties of the total fiber discharge is achieved is not fully comprehensible. It nevertheless remains that extensive testing has established this as a fact.

The rejects of the secondary cleaner(s) 98 are first passed to and through secondary cleaners 100, the function of which results in the production of further accepts which are recycled to and through the primary cleaner(s) 98 eventually to blend with the pulp being discharged to and through the disc thickeners 104. Any rejects developed in operation of the secondary cleaner(s) 100 are then directed to and through tertiary cleaner(s) 102 wherein a portion having potential acceptability is directed back to the wash tank 89 for repeated processing while its rejects are suitably disposed of, having no further use.

The foregoing are limited illustrations of the extreme versatility of the system and the practice of the invention which can be retrofitted to any existing mechanical pulping operation. As has been pointed out in the various examples, the system and process of the invention need only be applied to a minor fraction of a total furnish of mechanical pulp. In the blending of this fraction with the remainder one derives a pulp so improved as to its properties that no further addition of chemical pulp is essential to enable its use in the production of newsprint or other specialty grade papers.

The invention has not only solved those problems first described with reference to the prior art but has gone considerably beyond. The two stage sulfonation procedure has accomplished and produced each of the improvements in the individual fibers and their composites herein set forth. What is found most significant in a pulp furnish for newsprint and specialty grade papers which embody fibers sulfonated per the present invention are the improvements in wet stretch, dry breaking length and specific volume of fibers for a given refining energy level. In fact the prescribed sulfonation improves almost all of the properties of the mechanical pulp fibers to which the same is applied and the remaining are not detrimental in any perceptible manner to the end product.

Recent tests of the application of the invention to Uncoated Supercalendered sheet paper have emphasized its significance. Historically this grade of paper has been made with a fine mechanical pulp (GWD or TMP) and a large proportion of refined Kraft fibers and clay. The latter has been used to improve scattering coefficient, smoothness and showthrough. Note, however, the chemical pulp (Kraft) is there only for its contribution to the network strength properties, as it adversely affects opacity and printing properties. In turn, the clay reduces strength. Fibers sulfonated per the present invention naturally replace Kraft in furnish for this and like grades of paper. In their use they provide strength without adverse effects on opacity and printability which occur in use of Kraft. At the same time there is enabled a substantial reduction in the clay required to compensate for loss of scattering coefficient.

The following has been derived in tests comparing a commercial prior art furnish for the production of Supercalendered sheet and a furnish for the same purpose which utilizes the system and process of the present invention.

CHARACTERISTICS OF SUPERCALENDERED HANDSHEETS

| PARAMETER | COMMERCIAL FURNISH - 54% TMP 29% Refined Bleached Kraft 17% Clay |
|---|---|
| Breaking Length, Km | 2.17 |
| Apparent Specific Volume CC's/G | 1.24 |
| Smoothness, | 61 |

-continued

| | |
|---|---|
| CC's/minute | |
| Gloss, % | 20 |
| Specific Scattering coefficient, $cm^2/g$ | 527 |
| Showthrough, % (after printing) | 3.8 |

| PARAMETER | SULFONATED FURNISH - 59% TMP 32% 2-Stage Sulfonated Refined Fibers 9% Clay |
|---|---|
| Breaking Length, Km | 2.34 |
| Apparent Specific Volume CC's/G | 1.53 |
| Smoothness, CC's/minute | 76 |
| Gloss, % | 19 |
| Specific Scattering coefficient, $cm^2/g$ | 531 |
| Showthrough, % (after printing) | 2.9 |

The beneficial results of the use of the two stage sulfonated fibers as contrasted to the use of Kraft are self-evident.

As pointed out above, the two stage or interstage sulfonation system, procedures and processes of the present invention need be applied to only a part of a furnish in a mechanical pulp processing operation and in the combination of such part with the remainder of the furnish, which has been conventionally processed, the whole thereof is endowed with improvements in its properties which make it eminently suited for use in the production of newsprint or other specialty grade paper, without the need for addition thereto of a conventional chemical pulp. It is recognized, however, that some individuals influenced by entrenched paper manufacturing practices of the prior art may use the sulfonation system and process of the present invention and still choose to add a small fraction of chemical pulp to the resultant sulfonated product. It is also recognized that some individual may deem it desirable to add a fraction of conventional chemical pulp to the sulfonated product of the invention for some other special application. In either case, substantial benefits derive such as herein set forth. Such is contemplated by and forms part of the present invention.

From the above description it will be apparent that there is thus provided a device of the character described possessing the particular features of advantage before enumerated as desirable, which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A system for use in producing mechanical pulp suited for newsprint and other specialty grade papers obviating need for addition thereto of chemical pulp as practiced in the prior art comprising a first receptacle, means interconnecting said first receptacle with plural sources of supply operative to provide a delivery and introduction to said first vessel of quantities of a sulfite solution and fibrous solids in a relatively high consistency slurry form in amounts proportioned to produce in said first receptacle a composite slurry the consistency of which does not materially exceed 7%, means conditioned on delivery of said proportioned amounts of said slurry and sulfite solution to said first vessel to subject them to a brief interval of mixing in said first receptacle sufficient only to place a limited portion of the sulfite in said composite slurry in surface contact with portions of the fibers exposed at the surfaces of its solids to initiate a sulfonation thereof, a second receptacle defining a dwell chamber interconnected with said first receptacle to receive therefrom the composite slurry produced therein and hold it in a relatively quiescent state for a limited predetermined interval of time sufficient for the sulfonation initiated in said first receptacle to self propagate and complete a first stage sulfonation of the fiber content of its solids the level of which is the range of about 0.5 to 0.9%, means connected to said second receptacle to receive and extract from said composite slurry, the sulfonation level of the fiber content of which is in the range of about 0.5 to 0.9%, an amount of the liquid thereof including a major portion of the sulfite in solution originally applied to form part of said composite slurry, thereby to provide a remainder of said composite slurry having a substantially increased consistency the sulfonation level of the fiber content of which is in the range of about 0.5 to 0.9%, means interconnecting said extracting means with said first receptacle to deliver said extracted liquid back to said first receptacle for reuse on a further portion of said composite furnish delivered thereto for the sulfonation of fiber content thereof in like manner, and a pressurized vessel, means to direct said remainder of said composite slurry into said pressurized vessel, said pressurized vessel having in association therewith means to subject said remainder to an environment of highly elevated temperature and corresponding above atmospheric pressure to cause the sulfite in said remainder of said pulp slurry to further react on and provide the fiber content of said remainder with a sulfonate level in excess of 0.9% and produce thereby a quality of mechanical pulp rendering it eminently suited for use in producing newsprint and other specialty grade papers without need for addition thereto of chemical pulp as practiced in the prior art.

2. A retro-fit system, for producing pulp highly suited for newsprint and other specialty grade papers from mechanical pulp furnish the fibrous solids content of which is embodied in a high consistency slurry form and fiber elements thereof are exposed at surface portions thereof at least in part, comprising separate and distinct sources of sulfite solution and said mechanical pulp furnish, means for simultaneously directing controlled proportioned amounts of said sulfite solution and said mechanical pulp furnish into a first tank to produce an intermingling thereof and a composite slurry the consistency of which does not materially exceed 7% and inherently place small portions of the sulfite in solution in intimate contact with exposed surface portions of the fiber content of said slurry to initiate a sulfonation thereof, a second tank defining a dwell chamber immediately downstream of said first tank, means to direct said composite slurry from said first tank to said dwell chamber on the achievement of said composite slurry in said first tank and provide a limited period of time for said composite slurry to dwell in said chamber with its fibrous content in a substantially quiescent state allowing a self propagation of the sulfonation thereof endowing wood fibers in said composite slurry with sulfonate levels between 0.5% and 0.9% without any further application thereto of any amount of said sulfite solution or cooking thereof, thereby effecting a first stage sulfonation thereof, de-watering means immediately following said second tank and receiving therefrom said composite slurry the fiber content of which has been so sulfonated, said de-watering means being constructed and arranged to effect a separation from said composite slurry of a portion of its liquid content including a major portion of the sulfite solution delivered to said first tank with the aforesaid proportioned amount of said pulp furnish, thereby to provide a remainder of said composite slurry having a relatively increased consistency, said de-watering means further having in connection therewith means to direct said separated portion of said liquid content of said composite slurry for its reuse in combination with and in application to the solids content of a further portion of said furnish delivered to said first tank for the sulfonation of its solids content in said system in the same manner as the solids content of the aforesaid proportioned amount of said pulp furnish delivered to said first tank, and a pressurized vessel and means to direct said remainder into said pressurized vessel, said pressurized vessel having in association therewith means to subject said remainder to an environment of highly elevated temperature and corresponding above atmospheric pressure to cause the original sulfite remaining in said remainder to per se further react on and provide the fiber content of said remainder with a sulfonate level in excess of 0.9% without need for addition of further chemicals thereto within said pressurized vessel.

3. A retrofit system for use in producing pulp highly suited for newsprint and other specialty grade papers from mechanical pulp furnish without necessity of the use of expensive chemicals comprising separate and distinct sources of sulfite solution and said mechanical pulp furnish the latter of which has a relatively high consistency slurry form the solids content of which has the form of fibers and fiber bundles, means for directing controlled proportioned amounts of said sulfite solution and said mechanical pulp furnish into a first receptacle and briefly intermixing the same in the process thereof to produce therefrom a composite slurry the consistency of which does not materially exceed 7% and inherently place minor portions of the sulfite in solution in intimate contact with exposed surface portions of the fiber content of said slurry to thereby initiate a reaction therebetween, a second receptacle constituting a dwell chamber immediately following said first receptacle presenting an environment within which the temperature is below 212°, means to immediately move said composite low consistency slurry, on the achievement thereof, to said dwell chamber to dwell therein for a period of time limited in accordance with the nature of the wood from which said fibers and fiber bundles are derived to propagate and effect a first stage sulfonation thereof endowing said fibers with bound sulfur level expressed as sulfonate content in the general range of 0.5 to 0.9%, means immediately following said second receptacle to receive therefrom said composite slurry embodying the so sulfonated fiber content thereof and effect a separation from said composite slurry of a portion of its liquid content including a major portion of the sulfite solution delivered to said first tank with the aforesaid proportioned amount of said pulp furnish, thereby to provide a remainder of said composite slurry having a relatively increased consistency, said last named means further having in connection therewith means to direct said separated portion of said liquid content of said composite slurry for its reuse in combination with and in application to the solids content of a further portion of said furnish delivered to said first tank for the sulfonation of its solids content in said system in the same manner as the solids content of the aforesaid proportioned amount of said pulp furnish delivered to said first receptacle, means presenting therein a pressurized vessel having means to subject said remainder to a temperature in excess of 212° F. positioned immediately following said separating means to receive said remainder of said composite slurry for a further dwell interval therein endowing the fiber content of said remainder with a high sulfonate level in excess of 0.9% in a second stage sulfonation thereof to produce a highly sulfonated pulp well suited without addition of expensive chemical for use per se or the blending and/or processing thereof into or with and the sulfonation of a furnish of conventionally refined pulp to a degree to lend it all those properties desirable for a furnish for the production of newsprint or other specialty grade papers.

4. A retrofit system as in claim 3 wherein said separate and distinct sources of sulfite solution include a source of sulfite solution the sulfite content of which is in the general range of 40 to 180 g/l and said means immediately following said second receptacle to receive therefrom said composite slurry embodying the so sulfonated fiber content thereof and effect a separation from said composite slurry of a portion of its liquid content including a major portion of the sulfite solution delivered to said first tank with the aforesaid proportioned amount of said pulp furnish is a press.

5. A retro-fit system applicable to any mechanical pulp refining installation or stage thereof facilitating an inexpensive, efficient and inexpensive mode of producing a high quality economical mechanical pulp product well suited for use in the production of newsprint and other specialty grade papers comprising separate and distinct sources of sulfite solution and a mechanical pulp furnish, a first vessel, means to effect a metered delivery to and a mixing in said vessel of proportioned amounts of a sulfite solution and a pulp furnish having a relatively high consistency slurry form and a solids content which comprises fibrous materials to create within said vessel a slurry composite the consistency of which does not materially exceed 7% and place the fiber content of said slurry, to the extent of the exposure of surface portions thereof, in individual intimate contact with small portions of the sulfite in solution to initiate a sulfonation thereof, means connected to said first vessel including a second vessel presenting an atmospheric environment constructed and arranged to receive said slurry composite and hold it in a relatively small amount of the sulfite content of said slurry composite, a self propagation of the sulfonation of the fiber content of the slurry to a level of at least about 0.5% to essentially complete a first stage sulfonation thereof, means connected with said second vessel to receive the resultant slurry the fiber content of which has been so sulfonated and effect a separation from said slurry, for reuse in similar manner and for like purposes, of a portion of its liquid content including a major portion of the sulfite content of that solution delivered to said first vessel with the first said proportioned amount of said pulp furnish, thereby to provide a remainder of said slurry composite having an increased consistency the fiber content of which has been well sulfonated, and a pressurized vessel and means to direct said remainder of said slurry composite into said pressurized vessel, said pressurized vessel having in association therewith means to subject said remainder to an environment of highly elevated temperature and corresponding above atmospheric pressure to cause the sulfite in said remainder to further react on and, without the addition of further chemical, provide the fiber content of said remainder with a sulfonate level in excess of 0.9%.

6. A retro-fit system applicable to any mechanical pulp refining installation or stage thereof facilitating an inexpensive, efficient and inexpensive mode of producing a high quality economical mechanical pulp product well suited for use in the production of newsprint and other specialty grade papers comprising separate and distinct sources of sulfite solution and a mechanical pulp furnish, a first vessel, means to effect a metered delivery to and a mixing in said vessel of proportioned amounts of a sulfite solution and a pulp furnish having a relatively high consistency slurry form and a solids content which comprises fibrous materials to create within said vessel a slurry composite the consistency of which does not materially exceed 7% and place the fiber content of said slurry, to the extent of the exposure of surface portions thereof, in individual intimate contact with small portions of the sulfite in solution to initiate a sulfonation thereof, means connected to said first vessel including a second vessel presenting an atmospheric environment constructed and arranged to receive said slurry composite and hold it in a relatively small amount of the sulfite content of said slurry composite, a self propagation of the sulfonation of the fiber content of the slurry to a level of at least about 0.5% to essentially complete a first stage sulfonation thereof, means connected with said second vessel to receive the resultant slurry the fiber content of which has been so sulfonated and effect a separation from said slurry, for reuse in similar manner and for like purposes, of a portion of its liquid content including a major portion of the sulfite content of that solution delivered to said first vessel with the first said proportioned amount of said pulp furnish, thereby to provide a remainder of said slurry composite having an increased consistency the fiber content of which has been well sulfonated, a pressurized vessel and means to direct said remainder of said slurry composite into said pressurized vessel, said pressurized vessel having in association therewith means to subject said remainder to an environment of highly elevated temperature and corresponding above atmospheric pressure to cause the sulfite in said remainder to further react on and, without the addition of further chemical, provide the fiber content of said remainder with a sulfonate level in excess of 0.9%, and a liquor recovery press immediately following said pressurized vessel connected to receive said remainder of said slurry composite the fiber content of which has been sulfonated and separate therefrom a further portion of the remaining liquid content thereof which includes a residual portion of the sulfite in the solution applied with and to said first mentioned proportioned amount of said furnish in said first vessel, said press having in connection therewith means to deliver said further separated portion of said slurry and its sulfite content to a sulfite generating means in connection therewith, there being means in connection with said generating means to receive fresh sulfite solution therefrom, as and when required, which provides the means for effecting a controlled metered delivery to said first vessel of such amounts of sulfite solution as may be required for the initiation of the sulfonation of the fiber content of each successive amount of pulp furnish delivered to said first vessel for the sulfonation thereof in and by said system.

* * * * *